US006531218B2

(12) United States Patent
Hoyt et al.

(10) Patent No.: US 6,531,218 B2
(45) Date of Patent: Mar. 11, 2003

(54) DYED SHEATH/CORE FIBERS AND METHODS OF MAKING SAME

(75) Inventors: Matthew B. Hoyt, Brownstown Township, MI (US); Bobby J. Bailey, Candler, NC (US); Stanley A. McIntosh, Candler, NC (US); Phillip E. Wilson, Asheville, NC (US); Gary W. Shore, Asheville, MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/844,269

(22) Filed: Apr. 30, 2001

(65) Prior Publication Data

US 2002/0004137 A1 Jan. 10, 2002

Related U.S. Application Data

(63) Continuation-in-part of application No. 09/139,081, filed on Aug. 24, 1998, which is a continuation-in-part of application No. 08/715,724, filed on Sep. 19, 1996.

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 2,939,201 | A | 6/1960 | Holland | 28/82 |
| 2,939,202 | A | 6/1960 | Holland | 28/82 |
| 2,989,798 | A | 6/1961 | Bannerman | 28/82 |
| 3,328,341 | A | 6/1967 | Corbin, Jr. | 260/45.8 |
| 3,616,183 | A | 10/1971 | Brayford et al. | 161/175 |
| 3,645,819 | A | 2/1972 | Fujii et al. | 156/148 |
| 3,679,541 | A | 7/1972 | Davis et al. | 161/172 |
| 3,769,541 | A | 10/1973 | Wood | 315/22 |
| 3,846,507 | A | 11/1974 | Thomm et al. | 260/857 |
| 3,900,676 | A | 8/1975 | Alderson | 428/372 |
| 3,939,636 | A | 2/1976 | Nakayama et al. | 57/140 |
| 3,987,139 | A | 10/1976 | Kozlowski et al. | 264/141 |
| 4,056,652 | A | 11/1977 | Gauntt | 428/400 |
| 4,075,378 | A | 2/1978 | Anton et al. | 428/97 |
| 4,145,473 | A | 3/1979 | Samuelson et al. | 428/373 |
| 4,154,881 | A | 5/1979 | Hirakawa et al. | 428/92 |
| 4,191,656 | A | 3/1980 | Marshall | 252/8.6 |
| 4,207,376 | A | 6/1980 | Nagayasu et al. | 428/367 |
| 4,264,484 | A | 4/1981 | Patel | 260/29.6 |

(List continued on next page.)

FOREIGN PATENT DOCUMENTS

| | | | |
|---|---|---|---|
| EP | 0 822 275 A2 | 2/1998 | D01F/6/60 |
| GB | 1 396 072 | 5/1975 | |
| WO | WO 98/11283 | 3/1998 | D01F/8/12 |

OTHER PUBLICATIONS

AATCC Evaluation procedure 1, "Gary Scale for Color Change", AATCC Technical Manual/1998, pp. 341–342.
ASTM Designation: D 4466–90; Standard Terminology for Multicomponent Textile Fibers, pp. 457–459.

*Primary Examiner*—N. Edwards
(74) *Attorney, Agent, or Firm*—Nixon & Vanderhye P.C.

(57) ABSTRACT

Dyeable and dyed filaments have a core and a sheath which entirely surrounds the core. The core is formed of a core polymer which is susceptible to dyeing by a dye bath chemical, while the sheath is formed of a sheath polymer which is resistant to dyeing by the dye bath chemical. When the filament is brought into contact with a dye bath containing the dye chemical, the dye chemical in the dye bath will physically diffuse or migrate through the sheath polymer to cause the core polymer to be dyed a color of the dye bath chemical, while the sheath polymer is substantially undyed thereby.

8 Claims, 6 Drawing Sheets

(1 of 6 Drawing Sheet(s) Filed in Color)

U.S. PATENT DOCUMENTS 4,302,507 A 11/1981 Cerutti et al. ..... 428/373
4,384,022 A 5/1983 Fowler ..... 428/296
4,496,630 A 1/1985 Furita et al. ..... 428/364
4,610,925 A 9/1986 Bond ..... 428/368
4,680,156 A 7/1987 Collier ..... 264/171
4,929,653 A 5/1990 Kletecka et al. ..... 524/96
4,956,236 A 9/1990 Wang ..... 428/373
4,963,409 A 10/1990 Liss et al. ..... 428/96
5,077,124 A 12/1991 Clark et al. ..... 428/364
5,082,720 A 1/1992 Hayes ..... 428/224
5,085,667 A 2/1992 Jenkins ..... 8/539
5,108,684 A 4/1992 Anton et al. ..... 264/176.1
5,162,074 A 11/1992 Hills ..... 156/644
5,164,261 A 11/1992 Windley ..... 428/364
5,223,340 A 6/1993 Moss et al. ..... 428/395
5,242,733 A 9/1993 Windley ..... 428/97
5,316,850 A 5/1994 Sargent et al. ..... 428/378
5,322,736 A 6/1994 Boyle et al. ..... 428/397
5,330,834 A 7/1994 Windley ..... 428/364
5,340,886 A 8/1994 Hoyt et al. ..... 525/426
5,344,297 A 9/1994 Hills ..... 425/131.5
5,344,708 A 9/1994 Windley ..... 428/364
5,422,420 A 6/1995 Shridharani ..... 528/349
5,436,049 A 7/1995 Hu ..... 428/85
5,437,899 A 8/1995 Quigley ..... 428/35.7
5,445,884 A 8/1995 Hoyt et al. ..... 428/370
5,447,794 A 9/1995 Lin ..... 428/373
5,464,676 A 11/1995 Hoyt et al. ..... 428/85
5,464,684 A 11/1995 Vogelsang et al. ..... 428/229
5,468,555 A 11/1995 Lijten et al. ..... 428/365
5,549,957 A 8/1996 Negola et al. ..... 428/92

Ozone Fastness of Beige Continuous Dyed Fabric

Ozone Fastness of Gray Continuous Dyed Fabric

Ozone Fastness of Disperse Blue Continuous Dyed Fabric

DYED SHEATH/CORE FIBERS AND METHODS OF MAKING SAME

CROSS-REFERENCE TO RELATED APPLICATIONS

This application is a continuation-in-part of U.S. patent application Ser. No. 09/139,081 filed on Aug. 24, 1998, which in turn is a continuation-in-part of U.S. patent application Ser. No. 08/715,724, filed Sep. 19, 1996, the entire content of each prior application being incorporated expressly hereinto by reference.

FIELD OF THE INVENTION

This invention relates to stain-resistant, dyeable sheath/core filaments and methods. More particularly, this invention relates to sheath/core filaments wherein the core component is susceptible to dyeing by dye chemicals in a dye bath, while the sheath component is resistant to dyeing by such dye chemicals in the dye bath.

BACKGROUND AND SUMMARY OF THE INVENTION

As used herein, "dyed" refers to the results of an intentional coloration process performed by exhaust or continuous dyeing methods that are known in the art after the material (i.e., fiber) is extruded by incorporating one or more colored chemical compositions into the material at elevated temperature. In contrast, the term "stained" means the discoloration of fibers caused by the binding of a colored material either ionically, covalently, or through chemical partitioning to the fiber. The term "stain resistant" and "stain resistance" as used herein with respect to polyamide fibers or carpets refers to the ability of the fiber or carpet to resist red drink and/or coffee stains. "Inherently chemically compatible" means that the materials referred to are miscible.

Polyamide fibers are relatively inexpensive and offer a combination of desirable qualities such as comfort, warmth and ease of manufacture into a broad range of colors, patterns and textures. As a result, polyamide fibers are widely used in a variety of household and commercial articles, including, e.g., carpets, drapery material, upholstery and clothing. Carpets made from polyamide fibers are a popular floor covering for both residential and commercial applications.

Polyamide fibers tend to be easily permanently stained by certain natural and artificial colorants such as those found in such common household beverages as coffee, wine and soft drinks. Such household beverages may contain a variety of colored anionic compounds including acid dyes, such as the red dyes used in children's drinks. The stains resulting from such compounds cannot easily be removed under ordinary cleaning conditions.

The ability of a staining material like an acid dye to bind to a fiber is a function of the type of active functional groups on the fiber and of the staining material. For example, polyamides usually have terminal (often protonated) amine groups which bond with negatively charged active groups on an acid dye (or staining agent).

A commonly used acid dye colorant and one which severely stains nylon at room temperature is Color Index ("C.I.") Food Red 17, also known as FD&C Red Dye 40. Acid dyes such as C.I. Food Red 17 often form strong ionic bonds with the protonated terminal amine groups in the polyamide polymers, thereby dyeing, i.e., staining, the fiber. Thus, in contrast to soils which are capable of being physically removed from the polyamide carpet by typical cleaning procedures, acid dye colorants such as C.I. Food Red 17 penetrate and chemically react with the polyamide to form bonds therewith which make complete removal of such colorants from the polyamide fibers impractical or impossible.

The exact mechanism of coffee as a staining agent is not well understood. However, as with acid dye stains, coffee stains are notoriously difficult to remove from polyamide carpet by conventional cleaning procedures.

This severe staining of carpeting is a major problem for consumers. In fact, surveys show that more carpets are replaced due to staining than due to wear. Accordingly, it is desirable to provide polyamide fibers which resist common household stains like red drink and coffee stains, thereby increasing the life of the carpet.

Methods to decrease the acid dye affinity of nylons by reducing the number of dye sites are known. For example, U.S. Pat. No. 3,328,341 to Corbin, et al. describes decreasing nylon dyeability with butrylactone. U.S. Pat. No. 3,846,507 to Thomm et al. describes reducing acid dye affinity of polyamide by blending a polyamide with a polymer having benzene sulfonate functionality. U.S. Pat. No. 5,108,684 to Anton et al. describes fibers made from polyamide copolymers containing 0.25 to 4.0 percent by weight of an aromatic sulfonate, which are stain-resistant to acid dyes. U.S. Pat. No. 5,340,886, Hoyt et al. describes acid dye resistant polyamide fibers made by incorporating within the polymer sufficient $SO_3H$ groups or salts thereof to give the polymer a sulfur content of between about 1 and about 160 equivalents per $10^6$ grams polymer and, chemically blocking with a chemical blocking agent a portion of amine end groups present in the sulfonated polymer. Modified polymers such as described in these patents are generally expensive to make.

In addition to polymer modifications, topical treatments for carpets have been proposed as a cost effective means to impart acid dye resistance to polyamide carpet fibers. These topical treatments may be sulfonated materials that act as "colorless dyes" and bind the amine dye sites on the polyamide polymer. Sulfonated products for topical application to polyamide substrates are described in, for example, U.S. Pat. No. 4,963,409 to Liss et al.; U.S. Pat. No. 5,223,340 to Moss, III, et al.; U.S. Pat. No. 5,316,850 to Sargent et al.; and U.S. Pat. No. 5,436,049 to Hu. (Hu describes also a polyamide substrate that is made by melt mixing a polyamide with an amine end group reducing compound prior to fiber formation.) Topical treatments tend to be non-permanent and to wash away with one or more shampooings of the carpet.

Fibers may be formed in a variety of shapes and from a variety of materials. For example, some fibers have more than one type of polymer in distinct longitudinally co-extensive portions of the transverse cross-section and extending along the length of the fiber. Fibers that have two such portions are known as "bicomponent fibers". Bicomponent fibers having one of the portions surrounding or substantially surrounding the other are referred to as having a sheath/core configuration.

Sheath/core bicomponent polyamide fibers are known. U.S. Pat. No. 5,445,884 to Hoyt and Wilson discloses a filament with reduced stainability having a polyamide core and a sheath of a hydrophobic polymer. The weight ratio between the core and sheath is from about 2:1 to about 10:1. If the sheath is very thin, a compatibilizer must be used. Compatibilizers are generally expensive. The compatibilizer can, in some cases, be eliminated by making the sheath relatively thick, i.e., more than 15 wt % of the cross-section. However, if the sheath material is expensive, this also can add significantly to the cost of the fibers.

U.S. Pat. No. 4,075,378 to Anton discloses sheath/core bicomponent polyamide fibers containing a polyamide core and a polyamide sheath. The core polyamide is acid-dyeable while the sheath polyamide is basic-dyeable due to sulfonation.

U.S. Pat. No. 3,679,541 to Davis et al. describes a sheath/core bicomponent filament having soil-release, anti-soil redeposition and antistatic properties through use of a copolyester or copolyamide sheath around a polyamide core.

U.S. Pat. No. 3,645,819 to Fujii et al. discloses polyamide bicomponent fibers for use in tire cords, bowstrings, fishing nets and racket guts.

U.S. Pat. No. 3,616,183 to Brayford discloses polyester sheath/core bicomponent fibers having antistatic and soil-release characteristics.

U.S. Pat. No. 2,989,798 to Bannerman describes sheath/core bicomponent which is said to have improved dyeability by modifying the amine end group level of the sheath relative to the core. The sheath has less amine end groups than the core.

Fibers that are non-round in transverse cross-section are known. For example, U.S. Pat. Nos. 2,939,202 and 2,939,201, both to Holland, describe fibers having a trilobal cross-section.

Polyamide fibers may be dyed to popular colors, usually after being tufted or woven into carpet face fiber. The dyestuffs used to dye the fibers are subject to fading. One mode of fading of dyed yarns is via ozone. This is a particular problem in areas that are near coastlines (i.e., hot and humid) or in homes that have electrostatic dust precipitators. Carpets installed in automobiles are also subject to heat and humidity. Ozone reacts with dyestuffs, especially disperse and cationic dyestuffs, and renders them colorless or off-shade. Acid dyestuffs are also susceptible to ozone fading. Fading is a significant barrier to the sales of uncolored nylon 6 yarn (which is intended to be dyed) into the commercial carpet (contrasted to the residential) market. To achieve acceptable ozone fading resistance in commercial applications, the yarn often must be pigmented during spinning rather than using the more flexible (with respect to color and style) dyeing processes that are performed at the carpet mill rather than upstream at the fiber producer.

Broadly, the present invention relates to dyeable filaments and methods. More specifically, the present invention relates to bath-dyed or dyeable filaments and methods for sheath/core filaments having a core and a sheath which surrounds entirely the core. The core is formed of a core polymer which is susceptible to dyeing by a bath dye chemical, while the sheath is formed of a sheath polymer which is resistant to dyeing by the bath dye chemical. When the filament is brought into contact with a dye bath containing the dye chemical, the dye chemical in the dye bath will be physically transported (that is, will diffuse, migrate or penetrate) through said sheath polymer to cause the core polymer to be dyed a color of the dye chemical, while the sheath polymer is substantially undyed thereby.

These and other aspects and advantages will become more apparent after careful consideration is given to the following detailed description of the preferred exemplary embodiments thereof.

BRIEF DESCRIPTION OF THE ACCOMPANYING DRAWINGS

The patent or application file contains at least one drawing executed in color. Copies of this patent or patent application publication with color drawing(s) will be provided by the Office upon request and payment of the necessary fee.

Reference will hereinafter be made to the accompanying drawings, wherein like reference numerals throughout the various FIGURES denote like structural elements, and wherein.

DETAILED DESCRIPTION OF THE INVENTION

Figure 1:
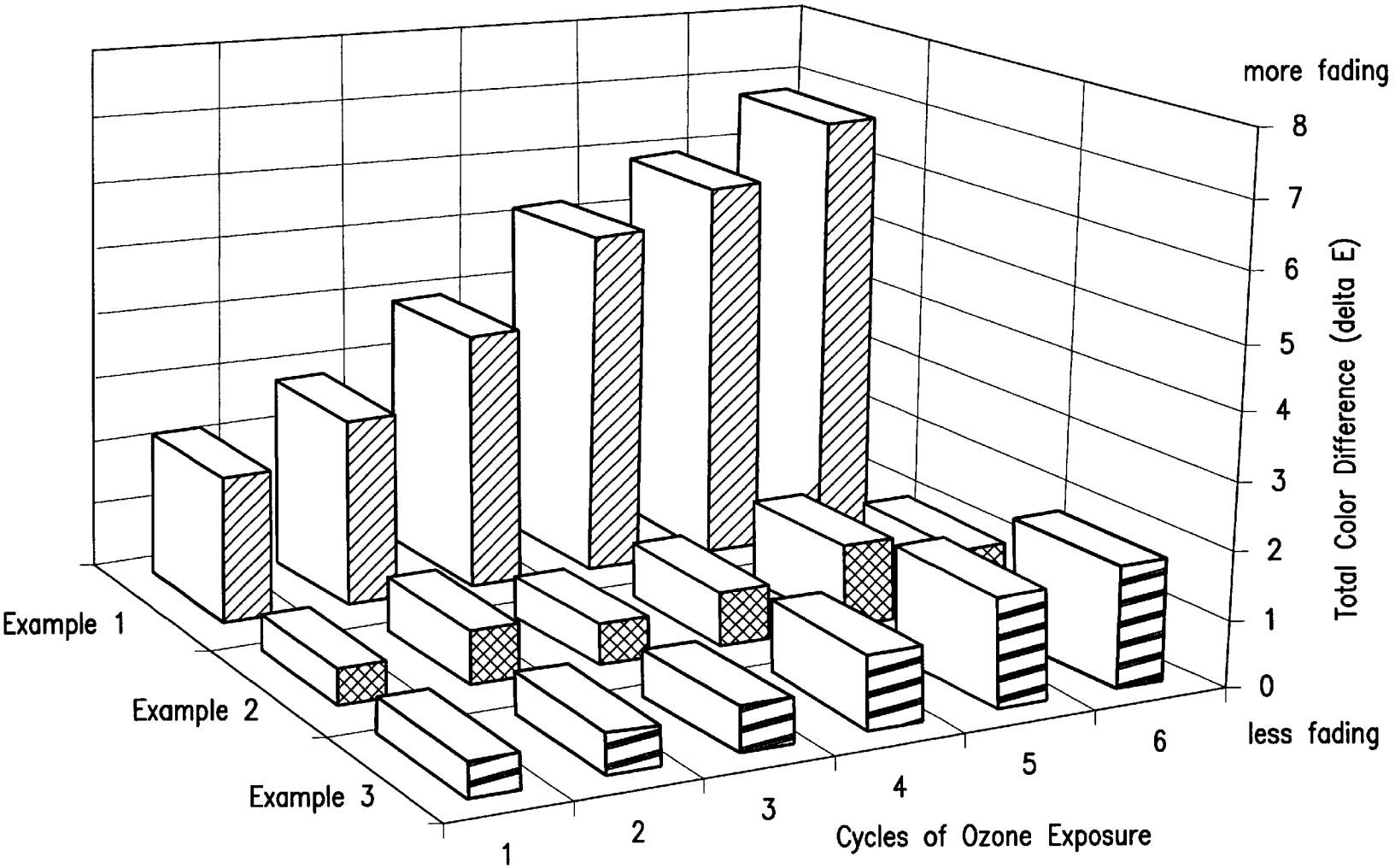
FIG. 1 is a bar chart showing ozone fastness in terms of $\Delta E^*$ values of carpet fibers dyed beige with acid dyes in a laboratory simulated continuous dyeing process, including dyed fibers used in the invention.

To promote an understanding of the principles of the present invention, descriptions of specific embodiments of the invention follow and specific language is used to describe them. It will nevertheless be understood that no limitation of the scope of the invention is intended by the use of specific language. Alterations, further modifications and such further applications of the principles of the invention discussed are contemplated as would normally occur to one ordinarily skilled in the art to which the invention pertains.

Dyed carpets made according to the present invention resist ozone fading. They also resist staining caused by both acid dyes and coffee and yet are dyeable with conventional polyamide dyeing methods. They exhibit lightfastness performance comparable to conventional dyed nylon 6 carpets so that this trait is not sacrificed (and might be improved).

These carpets are made from bicomponent face fibers composed of a polyamide core portion substantially or completely surrounded by a polymer that resists dye migration. The fibers are dyed with acid dyes, disperse dyes, or other dyes that are known to be susceptible to ozone fading or shade changes.

The fiber of this invention preferably contains from about 97% by weight to about 70% by weight of the core portion and from about 3% by weight to about 30% by weight of the sheath portion. More preferably, the fiber used in the carpet of this invention contains from about 97% by weight to about 85% by weight of the core portion and from about 3% by weight to about 15% by weight of the sheath portion. Most preferably, the fiber contains from about 97% by weight to 90% by weight of the core portion and about 3% by weight to less than 10% by weight of the sheath portion. In fact, it is surprising that sheath proportions less than 10 weight % show superior performance over sheath proportions around 10%, especially in ozone fastness.

The core may be formed from any fiber-forming polyamide or copolyamide. Fiber-forming polyamides suitable for the core include polymers having, as an integral part of the polymer backbone chain, recurring amide groups (—CO—NR—) where R is an alkyl, aryl, alkenyl, or alkynyl substituent. Non-limiting examples of such polyamides include homopolyamides and copolyamides which are obtained by the polymerization of lactam or aminocaproic acid or a copolymerization product from any of the possible permutative mixtures of diamines, dicarboxylic acids or lactams. The core may be an acid-dyeable polyamide such as a polyamide having amine end groups available as dye sites. Possibly, the core may be a basic-dyeable polyamide, such as made when polyamide forming monomers are polymerized in the presence of anionic groups such as sulfonated monomers. Such polyamides and methods of forming them are well known to those ordinarily skilled in the art and are generally among the class of polyamides having 15 or less carbon atoms in a repeating unit (or monomer in the case of mixed monomer starting materials). More preferably, the polyamide will have less than seven carbon atoms in the repeating unit such as in nylon 6. Other polyamides such as nylon 6/6, nylon 12, nylon 11, nylon 6/12, nylon 6/10, etc., that for some reason have been modified so that they have become stainable with acid dyes or coffee, may be used. Most preferably, the core polyamide is nylon 6 or nylon 6/6. Possibly, the core polyamide may have an amine end-group content of from greater than about 5 milliequivalents per kilogram (meq/kg) to less than about 100 milliequivalents per kilogram, more preferably from about 20 to about 50 milliequivalents per kilogram.

The sheath portion of the fiber is composed of a fiber forming polymer that resists dye migration (at room temperature, relative to nylon 6). Suitable polymers include polyolefins (e.g., polypropylene, polybutylene, etc.), fiber-forming polystyrene, fiber-forming polyurethane, and certain polyamides. Preferably, the sheath is composed of a polymer that is inherently chemically compatible with the core polymer. Preferably, the sheath is a polyamide polymer that is acid dye and coffee stain resistant, such that when the face fiber is exposed to C.I. Food Red No. 17, the red drink staining depth of the face fiber is about 15 or less CIEL*a*b* ΔE units under the Daylight 6500 Standard Illuminant; and such that when the face fiber is exposed to coffee, the coffee staining depth under Daylight 6500 Standard Illuminant is about 10 or less CIEL*a*b* ΔE* units. More preferably, the red drink staining depth is about 10 or less ΔE*units.

Preferably, the sheath polymer is a polyamide selected from the group consisting of polyamides having the structure:

(a) $[NH—(CH_2)_x—NH—CO—(CH_2)_y—CO]_n$ where x and y may be the same or different integers, preferably from about 4 to about 30 and the sum of x and y is greater than 13, more preferably from about 9 to about 20, and most preferably from about 9 to about 15 and n is greater than about 40; and (b)

$$[NH—(CH_2)_z—\overset{\overset{\displaystyle O}{\|}}{C}—]_m$$

where z is an integer preferably from about 9 to about 30, more preferably from about 9 to about 20, and most preferably from about 9 to about 15 and m is greater than about 40;

(c) derivatives of (a) or (b) including polymers substituted with one or more sulfonate, halogenate, aliphatic or aromatic functionality; and (d) copolymers and blends of (a), (b) and (c).

The preferable sheath polymers have greater than 80% of the non-carbonyl backbone or substituent carbons as alkyl, alkenyl, alkynyl, aryl, fluoroalkyl, fluoroalkenyl, fluoroalkynyl, fluoroaryl, chloroalkyl, chloroalkenyl, chloroalkynyl, chloroaryl, and the like, and do not have polar substituents such as hydroxy, amino, sulfoxyl, carboxyl, nitroxyl, or other such functionalities capable of hydrogen-bonding. Non-limiting examples of suitable fiber-forming polyamides which can be used as the sheath polyamide include nylon 6/10, nylon 6/12, nylon 10, nylon 11 and nylon 12. The fiber-forming sheath polyamide may be sulfonated but is preferably substantially sulfonate-free. Optionally, the sheath polyamide component may have a titratable amine-end-group concentration of less than about 30 meq/kg, and preferably less than about 15 meq/kg, and desirably less than about 10 meq/kg. If the polymers are amine end group blocked, useful amine-end-group-blocking agents include lactones, such as caprolactones and butyrolactones. Most preferably, the sheath polymer is nylon-6/12 having an AEG content of less than about 5.0 meq/kg. In preferred embodiments, the nylon-6/12 sheath polymer is a homopolymer.

As mentioned previously, the sheath of the fiber will preferably substantially or completely cover the core of the fiber. Methods for forming sheath/core fibers are known to those of ordinary skill in the art. One preferred method of forming sheath/core fibers is described in U.S. Pat. No. 5,162,074 to Hills, which is hereby incorporated by reference for the bicomponent spinning techniques taught therein. The sheath/core arrangement may be eccentric or concentric.

The fibers used as face fiber in the carpet of this invention are preferably multilobal. Trilobal cross-sections are currently preferred. Additionally, the fibers might contain one or more internal void spaces, for example, a central axial void.

The fibers used in this invention may be continuous fibers or staple fibers, either alone or in admixture with other fibers. The fibers are particularly useful as bulked continuous filament yarns.

Common melt-spinning and after processing techniques may be employed to make the fibers. The fibers may be textured to produce bulked yarns by known methods including stuffer-box crimping, gear-crimping, edge-crimping, false-twist texturing and hot-fluid jet bulking. Several ends may be combined in a variety of manners and twist levels according to conventional techniques, for example, groups of the fibers may be plied into yarn. The yarn may be cabled (i.e., plied and twisted). Preferably, the yarn is heatset.

It is especially preferred and especially beneficial if the fibers used in the present invention are cabled and heatset. As those of ordinary skill in the art will recognize, "cabled" refers to yarn that is plied and twisted. Cabling and heatsetting can be accomplished according to any method conventionally used in the art. It is not believed that the method of cabling or heatsetting is essential to the benefit of the invention. Typically, conventional dyed and heatset yarn has worse ozone fading performance (i.e., more fading upon ozone exposure) than dyed yarn that has not been heatset. However, it was surprisingly discovered that the carpets of the present invention have little degradation of ozone fading resistance from heatsetting. That is, the heatset face yarn on the carpet of the present invention performs at least as well as, and in some cases better than, non-heatset yarn.

Also, polyamide yarns will often shrink during heatsetting. Preferably, the fiber used in this invention has a steam heatsetting shrinkage value of about 70% or less relative to the steam heatsetting shrinkage value of fiber which is manufactured in the identical manner but which consists only of the core polyamide component.

Carpet may be made from the yarn by conventional carpet making techniques like weaving or tufting the face fibers into a backing material and binding the face fiber to the backing with latex or other adhesives. The carpet may be cut-pile, berber, multilevel loop, level loop, cut-pile/loop combination or any other style according to the popular fashion. If it is desired, the carpet of the present invention may be in the form of carpet tiles or mats. As an example, in the case of cut-pile carpeting, the yarn is tufted into a primary backing and the loops are cut to form cut-pile carpeting. The primary backing may be woven or non-woven and comprised of nylon, polyester, polypropylene, etc. The cut-pile carpeting is dyed to the desired shade. A secondary backing, if required, is adhered to the non-pile side, typically using a latex-based adhesive. The secondary backing may be jute, polypropylene, nylon, polyester, etc. The carpet of the present invention may be foam backed or not. The carpet of the present invention can be a variety of pile weights, pile heights and styles. There is not currently believed to be any limitation on the carpet style.

As noted, the fibers used in the carpets of the present invention are dyed with dyes, and exhibit surprising resistance to color fading under exposure to ozone. The fibers may be dyed before the carpet is made, such as with skein dyeing, or the fibers may be dyed when already present in the backing. That is, the constructed carpet may be dyed. Although a variety of dyes are envisioned for use in the present invention, the presently preferred dyes are: C.I. Acid Yellow 246, C.I. Acid Red 361, C.I. Acid Blue 277 and combinations of these with each other or other dyes. Dyes of similar chemical structures are also contemplated as useful to achieve the beneficial results of the present invention. Disperse dyes, which are notoriously unstable to ozone exposure are remarkably benefited by the present invention.

The invention will now be described by referring to the following detailed examples. These examples are set forth by way of illustration and are not intended to be limiting in scope. Knit fabrics are used in some of the following examples to demonstrate the stain resisting nature of fibers useful to make carpets of the present invention. This is merely for illustration and it is believed that the fibers would exhibit substantially identical attributes as face fiber in carpet.

The following test methods and procedures are used in the Examples:

Linear Density, Tenacity, Elongation, and Work to Break

The linear density, tenacity, elongation, and work to break are measured using test method ASTM D2256-97. The gauge length used is 10 inches (0.254 meters) and a cross head speed of 10 inches/min (0.0042 meters/second) is used.

Boiling Water Shrinkage

Boiling water shrinkage is determined using ASTM D2259-71.

Modification Ratio

For non-round cross-sections (e.g., trilobal), modification ratio is the ratio of the smallest possible circumscribed circle to the largest possible inscribed circle for a cross section of a filament from the yarn. The number reported is the average for 10 filaments.

Heatsetting

The yarn to be heatset is wound into skeins and is heatset in a standard autoclave used in the carpet industry. The first step of the heatsetting process in the autoclave involves raising the temperature to 110° C. for 3 minutes at a pressure of 6 psig (41 kPa). The pressure is then released and then the first step is repeated. The second step of the heatsetting process in the autoclave involves raising the temperature to 132° C. at pressure of 28 psig (193 kPa) for 3 minutes. The pressure is then broken and this step is repeated two more times.

Ozone Exposure Procedure

Using AATCC method 129-1996 (similar to ISO 105-G03) all dyed samples are subjected to 1, 2, 3, 4, 5 and 6 cycles of ozone fading. In this method (and other methods herein referencing the color or color change), the total color differences between exposed and corresponding unexposed samples are calculated using the CIEL*a*b* system as described by the Commission Internationale de I'Eclairage in CIE Publication No. 15 (E-1.3.1) for a Daylight 6500 standard illuminant.

A spectrophotometric measurement of the exposed and unexposed materials is made and the CIEL*a*b* total color difference (CIEL*a*b* $\Delta E^*$ (as used in this application: "$\Delta E^*$" or "Delta E*")) between the exposed and unexposed materials is calculated under the CIEL*a*b* system. For details of these calculations see, for example, Billmeyer, Jr., Fred W. and Saltzman, Max, *Principles of Color Technology,* John Wiley & Sons, New York (1966). The lower the $\Delta E^*$ value (i.e., the total color change from the unexposed control) the less the color of the material has changed.

The AATCC Color Change Gray Scale is a scale for visually rating the color change of a specimen relative to the differences shown by the scale. A 5 rating represents no color change. A 1 rating represents severe color change. A 3 rating represents noticeable, but in most cases, acceptable color change. For the purposes of this application, a delta E* value of 3.4 or less is equivalent to a 3 rating or better on the AATCC scale. In general, commercially acceptable ozone resistance performance is a $\Delta E^*$ rating of 3.2 or less.

As shown in the following examples, the present invention fades (as measured by $\Delta E^*$) after exposure to three cycles of ozone only one-half or less than a carpet having fiber composed substantially completely of the core polyamide (i.e., without the sheath) that is dyed with the same dyes. It should be noted that in making this comparison, the fibers and yarns used in the invention and the fibers and yarns made only of the core material must be of similar denier, cross-sectional shape and texturing. This is because any one of these factors can affect the apparent dye shade depth (as measured by the CIEL*a*b* system) of the unexposed sample used as the control for measuring ozone fade. For example, as a general rule, lower denier (per filament) yarn appears to dye less deeply than higher total denier (per filament yarn). Textured yarn dyes more deeply than untextured yarn, and so forth. This principle will be understood by those who are of at least ordinary skill in this art.

DYEING PROCEDURES

Laboratory Simulated Continuous Dyeing Procedure

A two yard (1.8 meter) sample of knitted tube is used. The volume of dye formulation is determined by the weight of the fabric to be dyed. In the examples, a 2.5:1 ratio of ml/g (bath volume to fabric weight) is used. The knitted tube is dipped into a beaker containing one of the dye formulations described below. In the process, the dye saturated fabric is squeezed and released several times distributing the dye bath uniformly throughout the knitted tube. The knitted tube is then exposed to 99° C. steam for 4 minutes. The knitted tubes are then rinsed in cold water and the excess water and dye bath is removed by extraction in a centrifugal extractor for 30 seconds.

The dye formulations are made according to the following recipe:

0.25 g/L ethylenediaminetetraacetate (Versene® from Dow Chemical Company, Midland, Mich.)

0.5 g/L dioctyl sulfosuccinate surfactant (Amwet DOSS from American Emulsion Co., Dalton, Ga.)

1.0 g/L anionic dye leveling agent (Amlev DFX, American Emulsion Co., Dalton, Ga.)

0.5 g/L trisodium phosphate acetic acid to adjust pH to 6.5

Dyestuffs according to the following

Acid Beige Dye:

0.132 g/L C.I. Acid Yellow 246 (Tectilon® Yellow 3R 200%)

0.088 g/L C.I. Acid Red 361 (Tectilon® Red 2B 200%)

0.088 g/L C.I Acid Blue 277 (Tectilon® Blue 4R)

Acid Gray Dye:

0.108 g/L C.I. Acid Yellow 246

0.116 g/L C.I. Acid Red 361

0.240 g/L C.I. Acid Blue 277

Acid Blue-Gray Dye:

0.068 g/L C.I. Acid Yellow 246

0.136 g/L C.I. Acid Red 361

0.424 g/L C.I. Acid Blue 277

Acid Green Dye:

0.980 g/L C.I. Acid Yellow 246

0.104 g/L C.I. Acid Red 361

0.532 g/L C.I. Acid Blue 277

4.976 g/L of Acid Blue dye with a green cast (Tectilon® Blue 5G)

Disperse Blue Dye:

0.132 g/L C.I. Disperse Blue 3 (Akasperse® Blue BN available from Akash Chemicals & Dye-stuffs Inc. of Glendale Heights, Ill.

(Tectilon Dyes are available from Ciba Specialty Chemicals, Greensboro, N.C.)

Exhaust Dyeing Procedure

A 30 g sample of knitted tube is placed in a closed container with one of the dye formulations below. The dye formulation was added at a 20:1 ratio (dyebath volume in mL to fabric weight in grams). The tube in the container is heated to 95° C. over 30 minutes and then held at 95° C. for an additional 30 minutes. The dyebath is then cooled and the knit tube is rinsed.

The dye formulations are made according to the following:

0.25 g/L ethylenediaminetetraacetate 0.5 g/L anionic dye leveling agent (Supralev® AC, available from Rhone-Poulenc, Inc., Lawrence, Ga.)

0.5 g/L trisodium phosphate acetic acid to adjust pH to 6.5

Dyestuffs according to the following recipes: ("owf" means on weight of fiber)

Acid Beige Dye:

0.033% owf C.I. Acid Yellow 246

0.022% owf C.I. Acid Red 361

0.022% owf C.I. Acid Blue 277

Acid Gray Dye:

0.027% owf C.I. Acid Yellow 246

0.029% owf C.I. Acid Red 361

0.060% owf C.I. Acid Blue 277

Acid Blue-Gray Dye:

0.017% owf C.I. Acid Yellow 246

0.034% owf C.I. Acid Red 361

0.106% owf C.I. Acid Blue 277

Acid Green Dye:

0.245% owf C.I. Acid Yellow 246

0.026% owf C.I. Acid Red 361

0.133% owf C.I. Acid Blue 277

1.244% owf Tectilon Blue 5G

Disperse Blue Dye 0.3% owf C.I. Disperse Blue 3

STAIN TESTING PROCEDURES

Acid dye and coffee stain resistance of the various fabric samples is determined according the following procedures. Generally, a $\Delta E^*$ value of less than 5 is considered essentially unstained; a $\Delta E^*$ value of 5 to 10 indicates very light staining; and a $\Delta E^*$ value of greater than 10 is considered significantly stained.

Stain Resistance to C.I. Food Red 17

"Red drink staining depth" refers to the "$\Delta E^*$" (total color difference) between stained and unstained samples as quantified using a spectrophotometer when samples are stained with C.I. Food Red 17 as follows. A solution of 100 mg C.I. Food Red 17 per liter of deionized water is prepared and adjusted to pH 2.8 with citric acid. Each sample to be tested is placed individually in a beaker in a 10:1 bath ratio of the red dye solution for five minutes at room temperature. After five minutes, the samples are removed, squeezed slightly by hand to remove excess liquid and placed on a screen to dry for 16 hours at room temperature. After 16 hours, the samples are rinsed in cold water until no more color is removed, centrifugally extracted and tumble dried. The color (stain) of the stain tested samples is measured on the spectrophotometer and $\Delta E^*$ is calculated relative to an unstained control.

Coffee Stain Resistance

"Coffee staining depth" refers to the $\Delta E^*$ value between stained and unstained samples as measured using a spectrophotometer when the stained samples are stained according to the following procedure. Coffee staining is measured by a spectrophotometer on knitted fabric samples stained as follows: A solution of 5.6 g Folger's® Instant Coffee per liter of deionized water is prepared and heated to 66° C. Each sample to be tested is spread out in the bottom of individual beakers and 2.5:1 bath ratio of the heated coffee solution is pipetted onto the sample in a manner as to distribute the coffee solution over the entire sample. The samples are allowed to remain in the beakers for 20 minutes and are then removed and placed on a screen to dry for 24 hours at room temperature. After 24 hours, the samples are rinsed in cold water until no more color is removed, then centrifugally extracted and tumble dried. The color (stain) of the samples is measured on a spectrophotometer and CIEL*a*b* Delta E* is calculated relative to an unstained control.

COLOR MEASUREMENT GENERALLY

In understanding the significance of the following examples, it is useful to understand the following principles of the CIEL*a*b* system. The system assigns color coordinates along three axes in three dimensional color space. The three axes are named L*, a* and b*. The L* value is a measurement of the depth of shade (lightness—darkness). An L* value of 100 is pure white and 0 is pure black. Therefore, the lower the L* value the darker the shade. A ΔL* value of 1 is visible to the naked eye viewing the samples side-by-side. A ΔL* value of 4–5 is significantly different.

The a* axis represents red and green. Negative a* values are green and positive values are red. The absolute value of the a* value rarely exceeds 20.

The b* axis represents yellow and blue. Negative b* values are blue and positive values are yellow. The absolute value of the b* value rarely exceeds 20.

EXAMPLE 1

(Comparative )—100% Nylon 6 Simulated Continuous Dyeing—Acid Beige Dye

A 100% nylon 6 ("N6") (from BS-700F chip available from BASF Corporation, Mt. Olive, N.J.) yarn is spun in a one-step spin-draw-texture ("SDT") process. The polymer temperature is 267° C. Two extruders are used. One extruder supplies the nylon 6 polymer as a core component to a bicomponent spin pack. The second extruder supplies the nylon 6 as a sheath. The sheath polymer is metered at 10% by weight of the nylon fed to the spin pack. A spin pack using the principles described in U.S. Pat. No. 5,344,297 to Hills is used to produce a sheath-core trilobal fiber. The draw ratio is about 3. The filaments are combined into a 58 filament yarn having the yarn properties summarized in Table 1.

The yarn is knitted on a circular weft knitting machine to make a knit tube. This tube is dyed using the simulated continuous dye procedure and the beige shade. The color change after ozone exposure is given in Table 2 and FIG. 1

EXAMPLE 2

(Invention)—10% Nylon 6,12 Sheath Simulated Continuous Dyeing—Acid Beige Dye Using the equipment and settings of Example 1 the nylon 6 in the second extruder is replaced with nylon 6,12 ("N6, 12") (poly(hexamethylene dodecanediamide)) (Vestamid® D16 available from Creanova, Somerset, N.J.). A 58 filament yarn is produced and has the properties summarized in Table 1.

The yarn is knitted on a circular weft knitting machine. The knit tube is dyed using the simulated continuous dye procedure using the beige shade formulation. In a first attempt to dye this yarn using the same formulation as used in Example 1 (comparative) the color is noticeably lighter than that achieved in Example 1. Accordingly, the dyeing procedure is modified by doubling the concentration of dyes (not auxiliaries) and lowering the pH to 6.0 with acetic acid. The time of steaming is doubled to 8 minutes. The resulting knitted tube has a similar depth of color to that achieved in Example 1. This tube (not the first attempt) is exposed to ozone and the color change after ozone exposure is given in Table 2 and FIG. 1.

EXAMPLE 3

(Invention) 5% Nylon 6,12 Sheath Simulated Continuous Dyeing—Acid Beige Dye

Using the equipment and settings of Example 1 the nylon 6 in the second extruder is replaced with nylon 6,12. The metering pumps supplying the spin pack are adjusted to provide 5% by weight of the nylon 6,12 from the second extruder. A 58 filament yarn is produced and has the properties summarized in Table 1.

The yarn is knitted into a tube on a circular weft knitting machine. This tube is dyed using the simulated continuous dye procedure given above using the beige shade formulation. Because the first attempt to dye this yarn using the same formulation as used in Example 1 (comparative) results in a noticeably lighter color than that achieved in Example 1, the modified dyeing procedure of Example 2 is followed. The resulting knitted tube has a similar depth of color to that achieved in Example 1. This tube (not the first attempt) is exposed to ozone and the color change after ozone exposure is given in Table 2 and FIG. 1.

TABLE 1

Properties of Yarns from Examples 1–3.

| Example | Total Linear Density (denier) | Tenacity (g/den) | Elongation (%) | Work to Break (g/cm) | Boiling Water Shrinkage (%) | Filament Modification Ratio |
|---|---|---|---|---|---|---|
| 1 | 1260 | 2.82 | 36.1 | 4452 | 9.1 | 2.52 |
| 2 | 1282 | 2.88 | 37.4 | 4726 | 7.3 | 2.70 |
| 3 | 1257 | 2.83 | 36.9 | 4197 | 6.3 | 2.62 |

TABLE 2

Acid Beige Dye (ΔE*)

| | | Ozone Cycles | | | | | |
|---|---|---|---|---|---|---|---|
| | | 1 | 2 | 3 | 4 | 5 | 6 |
| Ex 1 | 100% N6 | 2.2 | 2.8 | 3.9 | 5.2 | 5.9 | 6.7 |
| Ex 2 | 10% N6, 12 Sheath | 0.5 | 0.8 | 0.6 | 0.8 | 1.2 | 0.9 |
| Ex 3 | 5% N6, 12 Sheath | 0.6 | 0.6 | 0.7 | 1.1 | 1.6 | 1.8 |

EXAMPLE 4

(Comparative) 100% N6 Simulated Continuous Dyeing—Acid Gray Dye

Figure 2:
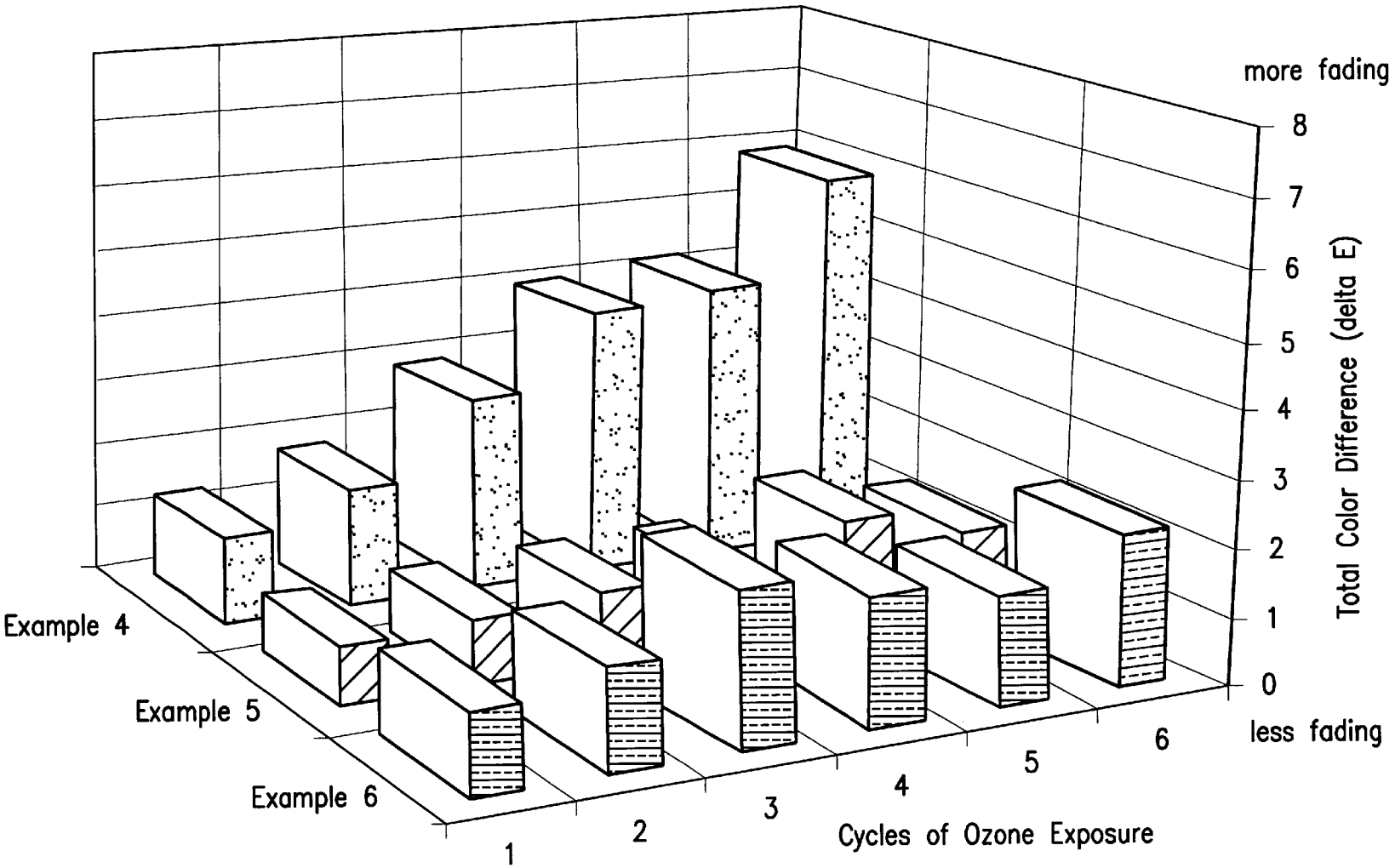
FIG. 2 is a bar chart showing ozone fastness in terms of $\Delta E^*$ values of carpet fibers dyed gray with acid dyes in a laboratory simulated continuous dyeing process, including dyed fibers used in the invention.

A knit tube of yarn from Example 1 is dyed using the simulated continuous dye procedure given above using the gray shade formulation. The color change after ozone exposure is given in Table 3 and FIG. 2.

EXAMPLE 5

(Invention) 10% N6,12 Sheath Simulated Continuous Dyeing—Acid Gray Dye

A knit tube of yarn from Example 2 is dyed using the simulated continuous dye procedure given above using the gray shade formulation. The color change after ozone exposure is given in Table 3 and FIG. 2.

EXAMPLE 6

(Invention) 5% N6,12 Simulated Continuous Dyeing—Acid Gray Dye

Figure 5:
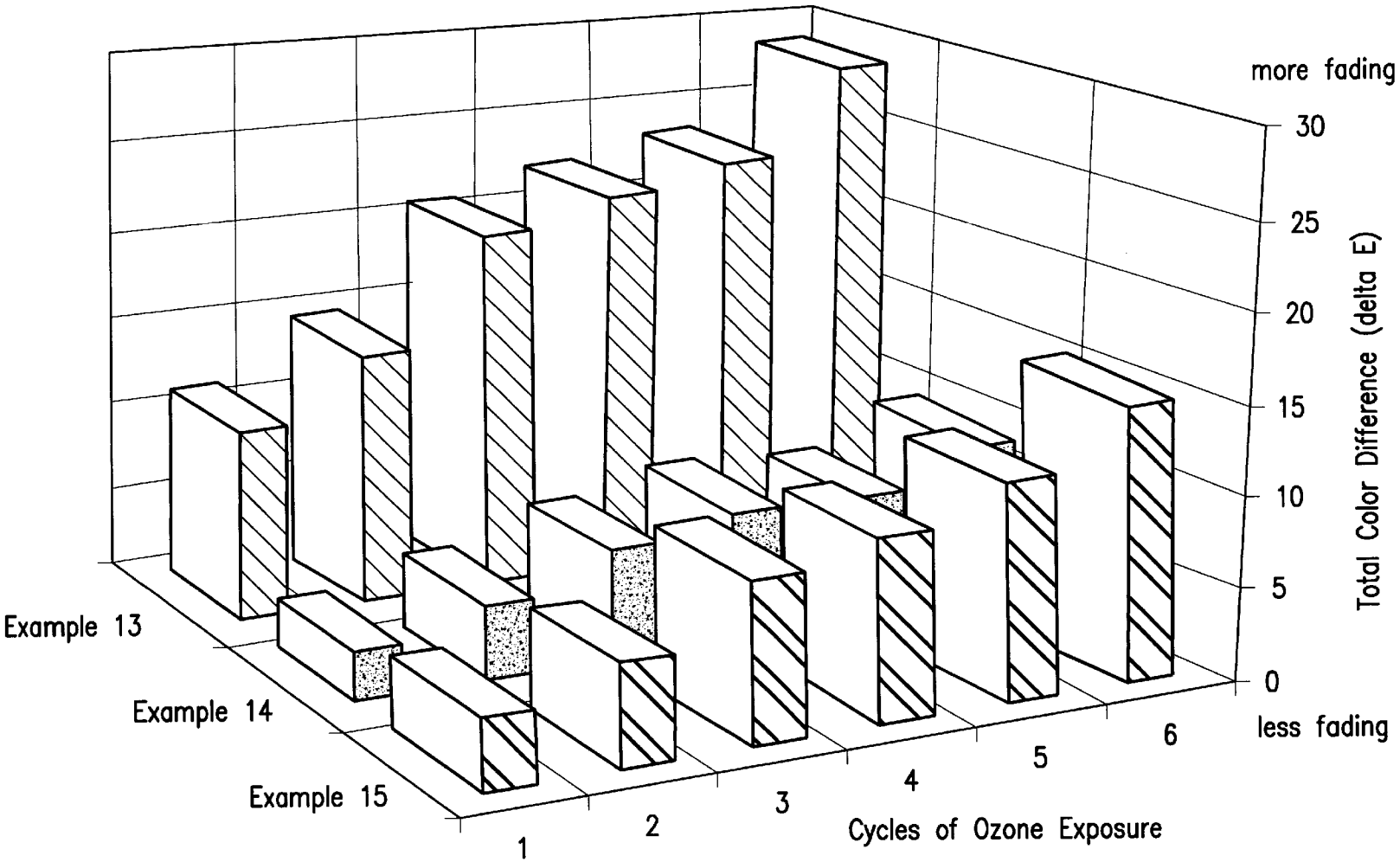
FIG. 5 is a bar chart showing ozone fastness in terms of $\Delta E^*$ values of carpet fibers dyed blue with disperse dyes in a laboratory simulated continuous dyeing process.

A knit tube of yarn from Example 3 is dyed using the simulated continuous dye procedure given above using the gray shade formulation. The color change after ozone exposure is given in Table 3 and FIG. 5.

TABLE 3

| | | Acid Gray Dye (ΔE*) | | | | | |
|---|---|---|---|---|---|---|---|
| | | Ozone Cycles | | | | | |
| | | 1 | 2 | 3 | 4 | 5 | 6 |
| Ex 4 | 100% N6 | 1.2 | 1.7 | 2.9 | 4.0 | 4.2 | 5.7 |
| Ex 5 | 10% N6, 12 Sheath | 0.8 | 0.9 | 1.0 | 1.0 | 1.5 | 1.2 |
| Ex 6 | 5% N6, 12 Sheath | 1.2 | 1.4 | 2.2 | 1.9 | 1.6 | 2.2 |

EXAMPLE 7

(Comparative) 100% N6 Simulated Continuous Dyeing—Acid Blue-Gray Dye

Figure 3:
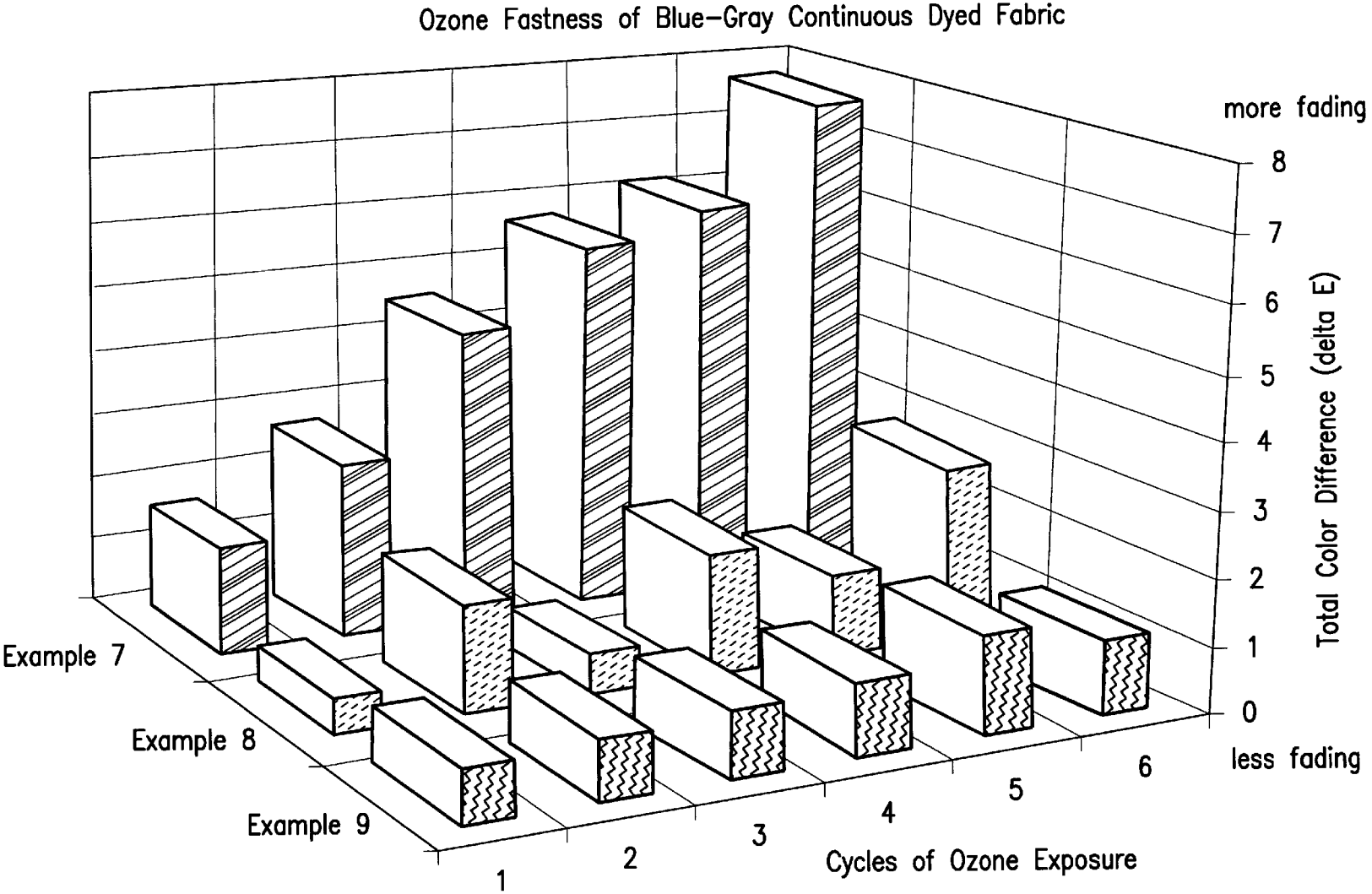
FIG. 3 is a bar chart showing ozone fastness in terms of $\Delta E^*$ values of carpet fibers dyed blue-gray with acid dyes in a laboratory simulated continuous dyeing process, including dyed fibers used in the invention.

A knit tube of yarn from Example 1 is dyed using the simulated continuous dye procedure given above using the blue-gray shade formulation. The color change after ozone exposure is given in Table 4 and FIG. 3.

EXAMPLE 8

(Invention) 10% N6,12 Sheath Simulated Continuous Dyeing—Acid Blue-Gray Dye

A knit tube of yarn from Example 2 is dyed using the simulated continuous dye procedure given above using the blue-gray shade formulation. The color change after ozone exposure is given in Table 4 and FIG. 3.

EXAMPLE 9

(Invention) 5% N6,12 Sheath Simulated Continuous Dyeing—Acid Blue-Gray Dye

A knit tube of yarn from Example 3 is dyed using the simulated continuous dye procedure given above using the blue gray shade formulation. The color change after ozone exposure is given in Table 4 and FIG. 3.

TABLE 4

| | | Acid Blue-Gray Dye (ΔE*) | | | | | |
|---|---|---|---|---|---|---|---|
| | | Ozone Cycles | | | | | |
| | | 1 | 2 | 3 | 4 | 5 | 6 |
| Ex 7 | 100% N6 | 1.6 | 2.7 | 4.6 | 5.7 | 6.1 | 7.6 |
| Ex 8 | 10% N6, 12 Sheath | 0.5 | 1.7 | 0.6 | 1.8 | 1.3 | 2.7 |
| Ex 9 | 5% N6, 12 Sheath | 0.8 | 0.9 | 1.0 | 1.0 | 1.5 | 1.2 |

EXAMPLE 10

(Comparative) 100% N6 Simulated Continuous Dyeing—Acid Green Dye

Figure 4:
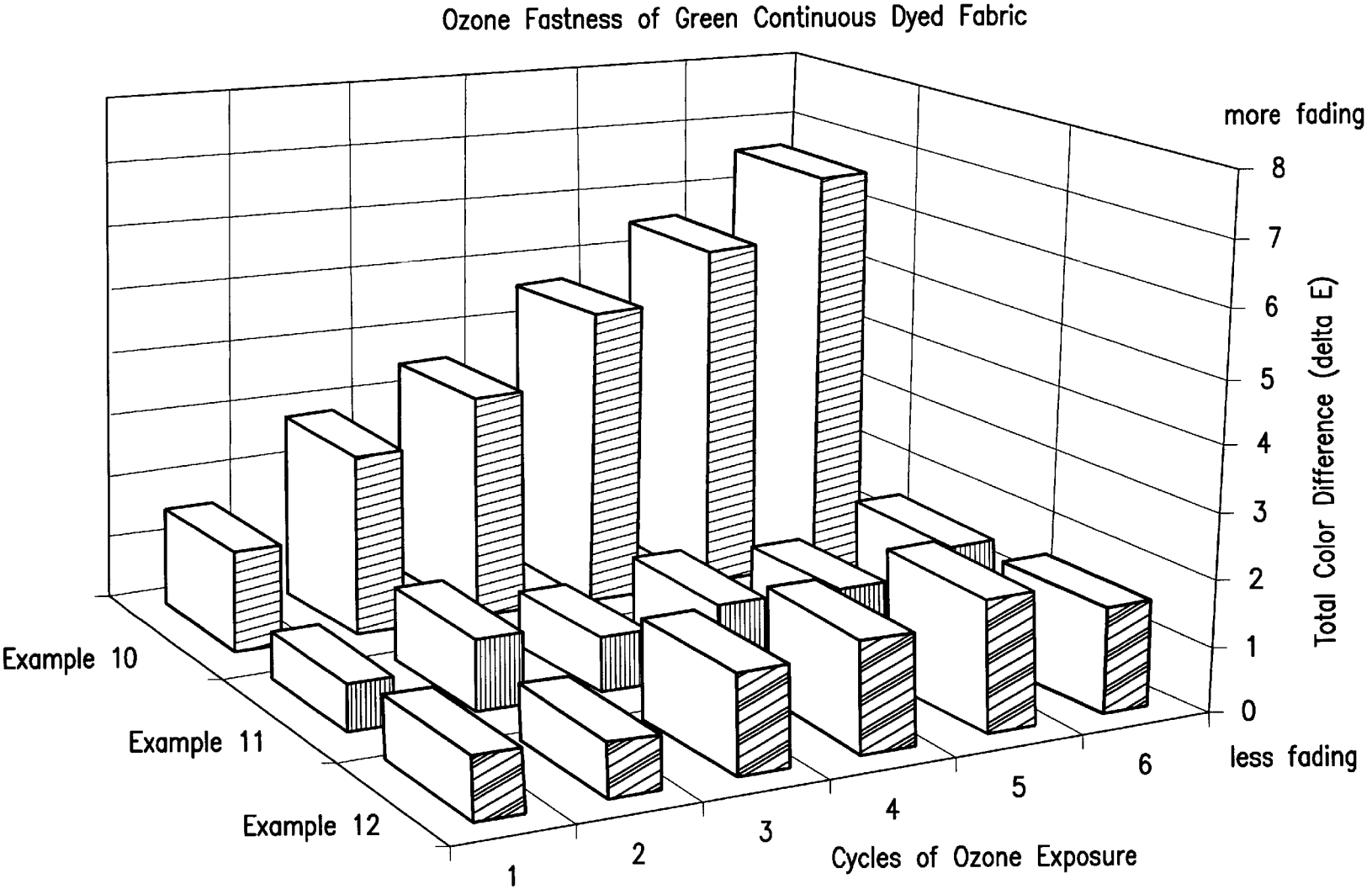
FIG. 4 is a bar chart showing ozone fastness in terms of $\Delta E^*$ values of carpet fibers dyed green with acid dyes in a laboratory simulated continuous dyeing process, including dyed fibers used in the invention.

A knit tube of yarn from Example 1 is dyed using the simulated continuous dye procedure given above using the green shade formulation. The color change after ozone exposure is given in Table 5 and FIG. 4.

EXAMPLE 11

(Invention) 10% N6,12 Sheath Simulated Continuous Dyeing—Acid Green Dye

A knit tube of yarn from Example 2 is dyed using the simulated continuous dye procedure given above using the green shade formulation. Because the first attempt at dyeing results in a shade that is noticeably lighter than that of Example 10. The dyeing procedure is modified as described in Example 2 and the resulting dyed knitted tube has a very similar color to that of Example 10. The color change after ozone exposure is given in Table 5 and FIG. 4.

EXAMPLE 12

(Invention) 5% N6,12 Sheath Simulated Continuous Dyeing—Acid Green Dye

A knit tube of yarn from Example 3 is dyed using the simulated continuous dye procedure given above using the green shade formulation. Because the first attempt at dyeing results in a shade that is noticeably lighter than that of Example 10, the dyeing procedure is modified as described in Example 2 and the resulting dyed knitted tube has a very similar color to that of Example 10. The color change after ozone exposure is given in Table 5 and FIG. 4.

TABLE 5

| | | Acid Green Dye (ΔE*) | | | | | |
|---|---|---|---|---|---|---|---|
| | | Ozone Cycles | | | | | |
| | | 1 | 2 | 3 | 4 | 5 | 6 |
| Ex 10 | 100% N6 | 1.7 | 2.9 | 3.6 | 4.8 | 5.6 | 6.7 |
| Ex 11 | 10% N6, 12 Sheath | 0.7 | 1.1 | 0.8 | 1.1 | 1.0 | 1.4 |
| Ex 12 | 5% N6, 12 Sheath | 1.0 | 0.8 | 1.5 | 1.7 | 2.0 | 1.6 |

EXAMPLE 13

(Comparative) 100% N6 Simulated Continuous Dyeing—Disperse Blue Dye

A knit tube of yarn from Example 1 is dyed using the simulated continuous dye procedure given above using the disperse blue formulation. The color change after ozone exposure is given in Table 6 and FIG. 5.

EXAMPLE 14

(Comparative) 10% N6,12 Sheath Simulated Continuous Dyeing—Disperse Blue Dye

A knit tube of yarn from Example 2 is dyed using the simulated continuous dye procedure given above using the disperse blue formulation. The color change after ozone exposure is given in Table 6 and FIG. 5.

EXAMPLE 15

(Comparative) 5% N6,12 Sheath Simulated Continuous Dyeing—Disperse Blue Dye

A knit tube of yarn from Example 3 is dyed using the simulated continuous dye procedure given above using the disperse blue formulation. The color change after ozone exposure is given in Table 6 and FIG. 5.

TABLE 6

| | | Blue Disperse Dye (ΔE*) | | | | | |
|---|---|---|---|---|---|---|---|
| | | Ozone Cycles | | | | | |
| | | 1 | 2 | 3 | 4 | 5 | 6 |
| Ex 13 | 100% N6 | 11.0 | 14.4 | 20.7 | 22.1 | 23.1 | 28.3 |
| Ex 14 | 10% N6, 12 Sheath | 2.9 | 4.3 | 6.1 | 7.0 | 7.1 | 9.1 |
| Ex 15 | 5% N6, 12 Sheath | 3.8 | 5.8 | 8.6 | 10.1 | 11.8 | 15.0 |

EXAMPLE 16

(Comparative) 100% N6 Heatset and Exhaust Dyed with Acid Beige Dye

Yarn prepared as in Example 1 (except that it is not first knitted into a tube) is cabled to a twist level of 5 twists per inch (197 twists/meter) on a Volkmann cable twister and heatset. The yarn is then knitted on a circular weft knitting machine and dyed using the exhaust dye procedure given above using the beige acid dyes formulation. The color change after ozone exposure is given in Table 7 and FIG. 6.

EXAMPLE 17

(Invention) 10% N6,12 Sheath Heatset and Exhaust Dyed with Acid Beige Dye

The yarn from Example 2 is cabled, heatset, knit into a tube and exhaust dyed to a beige shade as described in Example 16. The color change after ozone exposure is given in Table 7 and FIG. 6.

EXAMPLE 18

(Invention) 5% N6,12 Sheath Heatset and Exhaust Dyed with Acid Beige Dye

The yarn from Example 3 is cabled, heatset, knit into a tube and exhaust dyed to a beige shade as described in Example 16. The color change after ozone exposure is given in Table 7 and FIG. 6.

TABLE 7

| | | Heatset - Exhaust Dyed Beige (ΔE*) | | | | | |
|---|---|---|---|---|---|---|---|
| | | Ozone Cycles | | | | | |
| | | 1 | 2 | 3 | 4 | 5 | 6 |
| Ex 16 | 100% N6 | 1.5 | 2.8 | 4.1 | 5.6 | 5.4 | 8.1 |
| Ex 17 | 10% N6, 12 Sheath | 0.5 | 0.4 | 0.8 | 0.6 | 0.9 | 1.0 |
| Ex 18 | 5% N6, 12 Sheath | 1.1 | 0.8 | 1.2 | 1.0 | 1.0 | 1.0 |

EXAMPLE 19

(Comparative) 100% N6 Heatset and Exhaust Dyed with Acid Gray Dye

The yarn from Example 1 is cabled, heatset, knit into a tube as described in Example 16 and exhaust dyed to a gray shade. The color change after ozone exposure is given in Table 8 and FIG. 7.

EXAMPLE 20

(Invention) 10% N6,12 Sheath Heatset and Exhaust Dyed with Acid Gray Dye

The yarn from Example 2 is cabled, heatset, knit into a tube as described in Example 16 and exhaust dyed to a gray shade. The color change after ozone exposure is given in Table 8 and FIG. 7.

EXAMPLE 21

(Invention) 5% N6 Heatset and Exhaust Dyed with Acid Gray Dye

The yarn from Example 3 is cabled, heatset, knit into a tube as described in Example 16 and exhaust dyed to a gray shade. The color change after ozone exposure is given in Table 8 and FIG. 7.

TABLE 8

| | | Heatset - Exhaust Dyed Gray (ΔE*) | | | | | |
|---|---|---|---|---|---|---|---|
| | | Ozone Cycles | | | | | |
| | | 1 | 2 | 3 | 4 | 5 | 6 |
| Ex 19 | 100% N6 | 1.7 | 3.6 | 6.1 | 7.1 | 8.3 | 10.7 |
| Ex 20 | 10% N6, 12 Sheath | 0.6 | 0.4 | 1.1 | 0.9 | 1.1 | 1.4 |
| Ex 21 | 5% N6, 12 Sheath | 0.6 | 0.3 | 1.0 | 0.8 | 0.9 | 1.3 |

EXAMPLE 22

(Comparative) 100% N6 Heatset and Exhaust Dyed with Acid Blue-Gray Dye

The yarn from Example 1 is cabled, heatset, knit into a tube as described in Example 16 and exhaust dyed to a blue-gray shade. The color change after ozone exposure is given in Table 9 and FIG. 8.

EXAMPLE 23

(Invention) 10% N6,12 Sheath Heatset and Exhaust Dyed with Acid Blue-Gray Dye

The yarn from Example 2 is cabled, heatset, knit into a tube as described in Example 16 and exhaust dyed to a blue-gray shade. The color change after ozone exposure is given in Table 9 and FIG. 8.

EXAMPLE 24

(Invention) 5% N6,12 Sheath Heatset and Exhaust Dyed with Acid Blue-Gray

The yarn from Example 3 is cabled, heatset, knit into a tube as described in Example 16 and exhaust dyed to a gray shade. The color change after ozone exposure is given in Table 9 and FIG. 8.

TABLE 9

| | | Heatset - Exhaust Dyed Blue-Gray (ΔE*) | | | | | |
|---|---|---|---|---|---|---|---|
| | | Ozone Cycles | | | | | |
| | | 1 | 2 | 3 | 4 | 5 | 6 |
| Ex 22 | 100% N6 | 2.0 | 4.3 | 5.6 | 7.6 | 8.7 | 10.7 |
| Ex 23 | 10% N6, 12 Sheath | 0.3 | 0.4 | 1.1 | 1.1 | 1.4 | 1.2 |
| Ex 24 | 5% N6, 12 Sheath | 0.4 | 0.5 | 0.9 | 0.8 | 0.9 | 0.7 |

EXAMPLE 25

(Comparative) 100% N6 Heatset and Exhaust Dyed with Acid Green Dye

The yarn from Example 1 is cabled, heatset, knit into a tube as described in Example 16 and exhaust dyed to a green shade. The color change after ozone exposure is given in Table 10 and FIG. 9.

EXAMPLE 26

(Invention) 10% N6,12 Sheath Heatset and Exhaust Dyed with Acid Green Dye

Yarn from Example 2 is cabled, heatset, knitted into a tube as described in Example 16. The knit tube is exhaust dyed to a green shade using the exhaust dye procedure except that, because in a first attempt to dye this yarn using the same formulation as used in Example 25 the color is noticeably lighter than that achieved in Example 25, the dyeing procedure is modified by increasing the length of the dyeing procedure from 30 minutes (1800 seconds) at 95° C. to 60 minutes (3600 seconds) at 95° C. A slight color difference from that of Example 25 is still noted. The color change after ozone exposure is given in Table 10 and FIG. 9.

EXAMPLE 27

(Invention) 5% N6,12 Sheath Heatset and Exhaust Dyed with Acid Green Dye

Yarn from Example 3 is cabled, heatset, knitted into a tube as described in Example 16. The knit tube is exhaust dyed to a green shade using the exhaust dye procedure except that, because in a first attempt to dye this yarn using the same formulation as used in Example 25 the color is noticeably lighter than that achieved in Example 25, the dyeing procedure is modified as described in Example 26. A slight color difference from that of Example 25 is still noted. The color change after ozone exposure is given in Table 10 and FIG. 9.

TABLE 10

Heatset - Exhaust Dyed Green (ΔE*)

| | | Ozone Cycles | | | | | |
|---|---|---|---|---|---|---|---|
| | | 1 | 2 | 3 | 4 | 5 | 6 |
| Ex 25 | 100% N6 | 1.1 | 2.4 | 3.4 | 4.2 | 4.8 | 5.8 |
| Ex 26 | 10% N6, 12 Sheath | 0.2 | 0.5 | 1.0 | 1.1 | 1.2 | 1.1 |
| Ex 27 | 5% N6, 12 Sheath | 0.8 | 1.0 | 1.6 | 0.7 | 0.9 | 1.1 |

EXAMPLE 28

(Comparative) 100% N6 Heatset and Exhaust Dyed with Disperse Blue Dye

The yarn from Example 1 is cabled, heatset, knit into a tube as described in Example 16. The tube is exhaust dyed with the disperse blue dye formulation. The color change after ozone exposure is given in Table 11 and FIG. 10.

EXAMPLE 29

(Comparative) 10% N6,12 Sheath Heatset and Exhaust Dyed with Disperse Blue Dye

The yarn from Example 2 is cabled, heatset, knit into a tube as described in Example 16. The tube is exhaust dyed with the disperse blue dye formulation. The color change after ozone exposure is given in Table 11 and FIG. 10.

EXAMPLE 30

(Comparative) 5% N6,12 Sheath Heatset and Exhaust Dyed with Disperse Blue Dye

The yarn from Example 3 is cabled, heatset, knit into a tube as described in Example 16. The tube is exhaust dyed with the disperse blue dye formulation. The color change after ozone exposure is given in Table 11 and FIG. 10.

TABLE 11

Heatset - Exhaust Dyed - Disperse Blue Dye (ΔE*)

| | | Ozone Cycles | | | | | |
|---|---|---|---|---|---|---|---|
| | | 1 | 2 | 3 | 4 | 5 | 6 |
| Ex 28 | 100% N6 | 20.2 | 32.8 | 41.4 | 42.0 | 44.7 | 46.6 |
| Ex 29 | 10% N6 Sheath | 3.3 | 6.3 | 10.4 | 10.9 | 13.7 | 14.1 |
| Ex 30 | 5% N6 Sheath | 2.3 | 4.3 | 5.4 | 6.8 | 7.9 | 8.5 |

EXAMPLE 31

Stain Testing—Undyed Samples and Dyed Samples

Knit tubes made as described in Examples 1–3 before dyeing, are subjected to the red drink stain test and the coffee stain test. Similarly, knit tubes dyed blue-gray as described in Examples 7–9 are subjected to red drink and coffee stain testing. The results are presented in Table 12.

TABLE 12

Stain Testing (ΔE*)

| | Undyed Red Drink | Dyed Red Drink | Undyed Coffee | Dyed Coffee |
|---|---|---|---|---|
| 100% N6 | 60.1 | 20.0 | 28.7 | 1.2 |
| 10% N6, 12 Sheath | 10.9 | 0.9 | 16.8 | 0.2 |
| 5% N6, 12 Sheath | 13.2 | 0.8 | 19.9 | 0.2 |

EXAMPLE 32

Comparative Dyeing Trials—N6 Yarn Versus N6,12 Yarn

EXAMPLE 32 A: N6

On a pilot scale spinning machine, a 100% N6 yarn is extruded from a single screw extruder at a melt temperature of 265° C. into a spinneret to produce 14 round filaments. The yarn is accumulated on a winder at approximately 400 meters/minute with the godets operated with a very small (less than 10 m/min) speed differential, such that the yarn is undrawn.

In a separate step this yarn is heated and drawn 3.1 times its original length on a drawknitting machine. The final linear density is approximately 252 denier. Knit tubes are formed from the yarn and these are dyed to beige, gray, blue-gray and green using the Exhaust Dye Procedure.

The color of the original tubes are measured according to the CIEL*a*b* system and the tubes are exposed to 1, 2, 3, 4, 5 and 6 cycles of ozone. The results are presented in Table 13.

EXAMPLE 32B—N6,12

N6,12 is extruded and formed into yarn as in Example 32A except that the first godet is slowed such that a draw ratio of 2:1 is induced in the yarn. The first godet runs at 200 m/min and the second at 400 m/min. This drawing step is required because the undrawn yarn does not form a stable package. The yarn relaxes on the package and cannot be processed.

In a separate step this yarn is knitted (bypassing the heating and drawing steps) on the same drawknitter as in Example 32A but without further drawing. Thus, the final linear density is approximately 391. Knit tubes are formed from the yarn and these are dyed to beige, gray, blue-gray and green using the Exhaust Dye Procedure.

The color of the original tubes are measured according to the CIEL*a*b* system and the tubes are exposed to ozone. The results are presented in Table 13.

TABLE 13

| | As Dyed Material | | | Relative to Nylon 6 Sample | | Ozone Fastness (ΔE* after respective number of cycles of exposure) | | | | | |
|---|---|---|---|---|---|---|---|---|---|---|---|
| | L* | a* | B* | Delta E* | Delta L* | 1 | 2 | 3 | 4 | 5 | 6 |
| Example 32A-Beige | 57.8 | 3.8 | 15.4 | | | 1.0 | 1.6 | 2.4 | 2.9 | 4.3 | 5.0 |
| Example 32B-Beige | 65.7 | 0.9 | 9.1 | 10.4 | 7.8 | 0.8 | 1.1 | 1.4 | 1.5 | 1.3 | 1.3 |
| Example 32A-Gray | 49.2 | −2.2 | 3.1 | | | 0.9 | 1.8 | 2.4 | 3.5 | 4.7 | 5.7 |
| Example 32B-Gray | 59.8 | −3.4 | 4.3 | 12.1 | 10.6 | 0.8 | 1.1 | 1.3 | 1.6 | 1.7 | 1.6 |
| Example 32A-Blue-Gray | 44.4 | −3.0 | −11.1 | | | 1.0 | 2.0 | 2.4 | 3.2 | 4.5 | 5.2 |
| Example 32B-Blue-Gray | 56.7 | −3.3 | −14.8 | 12.8 | 12.3 | 0.6 | 0.8 | 1.2 | 1.6 | 1.6 | 1.8 |
| Example 32A-Green | 30.9 | −20.0 | 11.0 | | | 0.6 | 0.8 | 1.0 | 1.0 | 2.0 | 2.5 |
| Example 32B-Green | 55.0 | −16.5 | 10.9 | 24.3 | −24.0 | 0.8 | 1.0 | 1.2 | 1.3 | 1.5 | 1.5 |

The Delta E* and Delta L* values compare the two similarly dyed knitted fabrics. The greater the Delta E* value the greater the difference in the appearance of the two shades. The Delta L* value is of particular interest here because this is a measure of the change in lightness/darkness of the two shades. Delta L* is calculated as follows:

$$L^*_{sample} - L^*_{standard} = \text{Delta } L^*.$$

For the values in the above table, a positive value for each of the Example 32B samples indicates the color is lighter, hence has dyed less. For all of the acid dyes examined, the fabrics made from nylon 6,12 did dye, but to a much smaller amount than those from Example A. Such a drastic reduction in color yield would be unacceptable under current carpet industry expectations for yarn dyeability.

EXAMPLE 33

Sheath Polymer Stain Screening

Polymer was charged into an extruder and extruded into mono-component trilobal filaments at about 270° C. The extruded filaments were cooled in air and lubricated with spin finish. Yarns comprised of the filaments were taken up on a winder at speed of about 900 m/min. The yarns were drawn prior to winding and the draw ratio was around 3. The final denier of the yarns with trilobal cross-section is 826 denier/64 filaments. The amino end group (AEG) content and stain test results are summarized in Table 14 below.

TABLE 14

| | AEG (meq/kg) | Food Red-17 Stain Test (Delta E) | Coffee Stain Test (Delta E) |
|---|---|---|---|
| Nylon-6 | 45.3 | 50.81 | 14.74 |
| Nylon-6,12 Homopolymer | 3.4 | 3.69 | 3.44 |
| Nylon-6,12 Copolymer | 48.0 | 57.17 | 18.78 |
| Nylon-6,12 Copolymer w/reduced AEG | 12.8 | 49.01 | 18.59 |

As can be seen from the data above, the nylon-6,12 homopolymer with low AEG content is an exemplary polymer suitable for the sheath component in sheath/core filaments due to its minimal staining with Food Red 17 and coffee.

EXAMPLE 34

Dyed Sheath Core Filament

Yarn formed of individual trilobal sheath/core filaments was spun with a bicomponent melt-spinning apparatus that keeps the molten sheath polymer stream separate from the core polymer stream until just before entering the spinneret hole capillary. The core polymer of the trilobal filaments was cationic dyeable nylon 6 polymer, BS 600C (BASF Corporation), and the sheath polymer was VESTAMID® D16 nylon 6/12 commercially obtained from Creanova. The core polymer contained 0.3% $TiO_2$ while the sheath contained no additives. The yarn is spun at 275° C. through a symmetrical trilobal capillary shape and cooled by a stream of cool quench air blowing across the filaments. The yarn sample was taken from within the cooling cabinet before the yarn was drawn or textured. The polymer pumps were set to deliver the sheath polymer at 15% (by weight) and the core polymer at 85% by weight.

The yarn was dyed along with production hoselegs with a laboratory dye procedure, as follows:

Dyeing Apparatus=Hunter Dye Beck

Dyestuff=Sevron Red YCN (0.4% owf)

Dyebath Auxiliaries=Luratex (1.0% owf) Intralan Salt HA (0.15% owf)

Liquor Ratio=40 to 1 pH =6.0 to 6.2 (Adjust with trisodium phosphate (TSP) or citric acid)

Dyeing=at boil for 30 minutes

Figure 6:
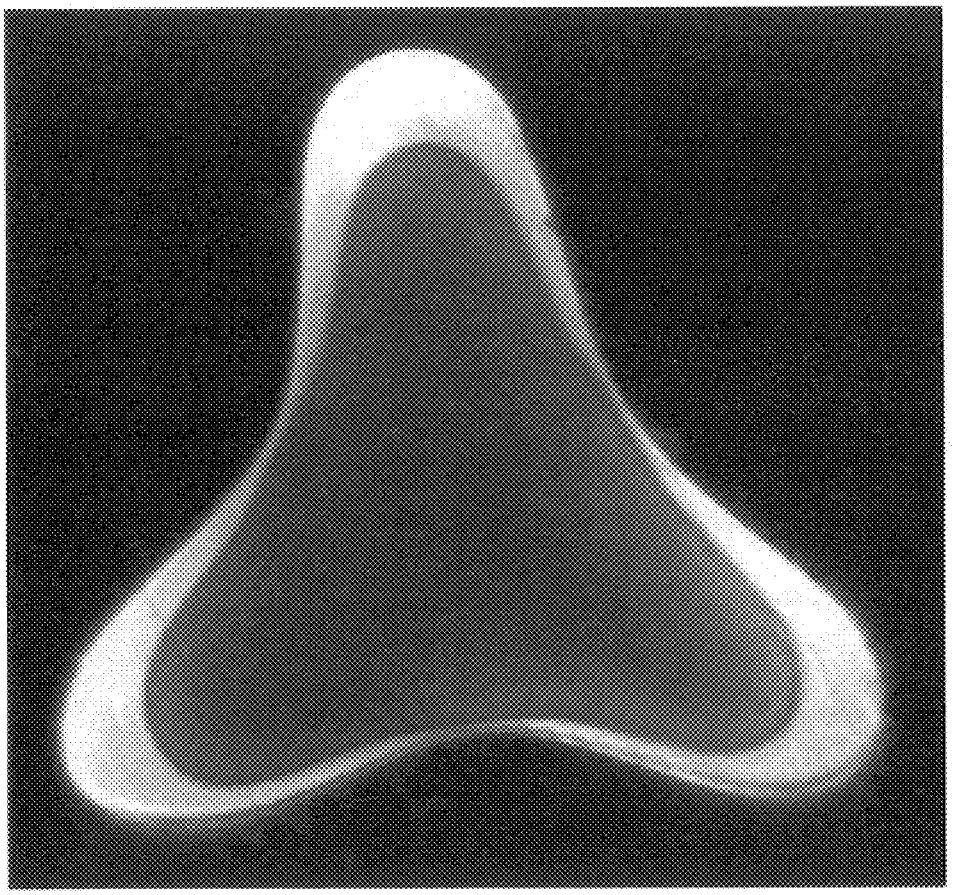
FIG. 6 is a color photomicrograph of a dyed sheath/core trilobal fiber cross-section in accordance with the present invention.

A photomicrograph of a cross-section of an exemplary dyed sheath/core filament is shown in accompanying FIG. 6. As can be seen, the dye in the dye bath physically penetrated the sheath so as to impart a dyed color to the core, while leaving the sheath substantially undyed. The color of the dyed core polymer was thus visibly perceptible through the substantially undyed sheath polymer providing a color dyed appearance to the yarn overall while retaining the stain resistance attributable to the sheath polymer.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sheath/core filament comprising a sheath formed of an essentially non-dyeable nylon sheath polymer which is resistant to, and thereby essentially undyed by, dyes, and a core entirely surrounded by the sheath and formed of a dyeable core polymer which is susceptible to dyeing by the dyes, wherein said filament includes less than about 10 wt. % of said sheath polymer.

2. The filament of claim 1, which is a trilobal filament.

3. The filament of claim 1, which has between about 90 wt. % to about 97 wt. % of the core polymer, and between about 3 wt. % to about 10 wt. % of the sheath polymer.

4. The filament of claim 3, wherein the core polymer is a nylon having an amine end group content (AEG) of between about 10 meq/kg to about 100 meq/kg, and wherein the sheath polymer is a nylon having an AEG of less than about 10 meq/kg.

5. The filament of claim 4, wherein the nylon sheath polymer has an AEG content of less than about 5 meq/kg.

6. The filament of claim 5, wherein the nylon sheath polymer is a nylon-6,12 homopolymer.

7. The filament of claim 1, wherein the core is a nylon polymer which is at least one selected from the group consisting of nylon-6, nylon-12, nylon-11, nylon-6/6, nylon-6/10 and copolymers and blends thereof.

8. The filament of claim 7, wherein the core nylon polymer has an amino end group (AEG) content of between about 10 meq/kg and about 100 meq/kg.

* * * * *